US006076634A

United States Patent [19]

Simon

[11] Patent Number: 6,076,634

[45] Date of Patent: Jun. 20, 2000

[54] MAST LADDER ASSEMBLY

[76] Inventor: Steve J. Simon, 1040 Birch St., Broomfield, Colo. 80020

[21] Appl. No.: 09/245,111

[22] Filed: Jan. 14, 1999

[51] Int. Cl.[7] ..... E04G 3/00

[52] U.S. Cl. ..... 182/100; 182/93; 114/90

[58] Field of Search ..... 182/100, 93, 189; 403/302, 305, 353, 300; 114/102, 90, 93, 363, 362, 39.1; D12/303

[56] References Cited

U.S. PATENT DOCUMENTS

| | | | |
|---|---|---|---|
| 24,044 | 5/1859 | Moulton | 182/189 X |
| 186,424 | 1/1877 | Jones . | |
| 372,982 | 11/1887 | Judd | 182/93 |
| 414,686 | 11/1889 | Dinn | 182/189 |
| 3,930,562 | 1/1976 | Zorn | 182/92 |
| 3,995,714 | 12/1976 | Brookes et al. | 182/100 |
| 4,258,828 | 3/1981 | Evans | 182/95 |
| 4,263,983 | 4/1981 | Norton | 182/93 |
| 4,355,701 | 10/1982 | Nicholson | 182/100 X |
| 4,577,726 | 3/1986 | Wheeler | 182/93 |
| 4,674,598 | 6/1987 | Sides et al. | 182/116 |
| 4,892,170 | 1/1990 | O'Donnell | 182/100 |
| 5,040,635 | 8/1991 | Strickland | 182/100 |
| 5,109,954 | 5/1992 | Skyba | 182/189 |
| 5,150,766 | 9/1992 | Bell | 182/100 |

*Primary Examiner*—Daniel P. Stodola
*Assistant Examiner*—Hugh B. Thompson
*Attorney, Agent, or Firm*—H. Kenneth Johnston II

[57] ABSTRACT

A mast ladder for going up the mast of a sailing craft having a mast with a sail slide extending along the length of the mast including a halyard slide, a plurality of connecting rods, a top step and a plurality of universal steps. The mast ladder is assembled by attaching an end of the halyard to the upper end of the halyard slide to raise the mast ladder up the mast. The halyard slide, the top step and each universal step engage the sail slide keeping the mast ladder against the mast and providing support to each step. As the mast ladder is raised, the halyard slide has a connecting rod attached at the lower end and the connecting rod is attached to the top step at the upper end and a subsequent connecting rod is attached to the lower end of the top step and to the first universal step at its left or right hand position, which are alternated as the mast ladder is raised to the desired height necessary to complete the work on the craft.

6 Claims, 3 Drawing Sheets

MAST LADDER ASSEMBLY

BACKGROUND OF THE INVENTION

There are many times when one needs to perform some maintenance, normal or otherwise on the mast of a sailing craft. One traditional way of providing such access is to permanently mount steps to the mast. Such is shown by Jones, U.S. Pat. No. 186,424. Numerous disadvantages to this access is seen as chaffing of sails, snagging of halyards and adding additional wind resistance. Other means consist of using a boatswain's chair which requires additional help to raise the individual and is less than ideal in times of inclement weather as the boatswain chair can swing away from the mast during times the boat is rolling or pitching. There are some mast ladders which utilize the halyard to raise them but they are cumbersome, do not provide a sturdy climbing structure and in some cases require a substantial amount of storage for the mast ladder when not in use. Such is the Sailboat Mast Ladder, U.S. Pat. No. 4,577,726 which is a nylon strapping sewn together forming the foot loops and straight sections of the ladder and is stored as a complete unit which takes up precious space on a sailing craft. There are numerous other pole climbing devices such as shown in Brookes et al. U.S. Pat No. 3,995,714 which is a multi-section ladder but does not provide the needed requirements as set forth for a sailing craft. The device is cumbersome and consumes a substantial amount of space. Norton, U.S. Pat. No. 4,263,983 is a bulky and cumbersome device for use on a sailing craft. Sides et al., U.S. Pat. No. 4,674,598 which is a single pole hunting stand is basically unworkable on a sailing craft. It requires guy wires to support and is an unacceptable means of scaling a sailing craft's mast. Skyba, U.S. Pat. No. 5,109,954 again is a cumbersome device which although provides a useful tool for scaling trees, poles and the like from the ground where the device does not have any storage restrictions, but becomes unacceptable for use on a sailing craft. Zorn, U.S. Pat. No. 3,930,562 provides a removal step climbing assembly which allows one to climb the mast, however, one must insert the steps as one climbs and then remove them as one descends from the mast. Although it does work, it is certainly more dangerous having to install and remove the steps as one ascends and descends the mast. In Evans, U.S. Pat. No. 4,258,828, a folding ladder is shown which folds into the mast. Although it does provide that the steps are out of the way when not in use, they are still affixed to the mast and is a complex system for installation.

SUMMARY OF THE INVENTION

The invention is directed to a sailing craft mast ladder for use with a sailing craft that has a mast with a mast sail slide which extends along the length of the mast. The mast ladder has minimal parts including a halyard slide for attaching the mast ladder to the halyard and raising the mast ladder. The halyard slide is connected by a connecting rod to the top step which in turn is connected to a universal step by another connecting rod. Each universal step is connected to the previous universal step by a connecting rod. The halyard slide, the top step and each universal step fit into and slide in the mast slide providing a sturdy platform to climb and work.

It is a primary advantage of the within invention to eliminate many of the problems associated with permanent mast ladders and boatswain's chairs. The invention is assembled on the mast only when needed and eliminates the problems with the permanently mounted steps and does not subject the worker to the swinging problems of the boatswain's chair.

A key feature of the within invention is the use of the connecting rod which provides a uniform space between each step and is compact and stored easily. Additionally, a specific feature of the within invention is the universal step which keeps the requirement for many different limited. The universal step forms its portion of the mast ladder merely by inserting the universal step into the mast slide for the left side or for the right side depending which step is needed next.

An additional advantage of the within invention is that the sailing craft does not require any modifications to utilize the within invention. The mast slide which is used for raising and lowering the sails is utilized for raising the mast ladder.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 1:
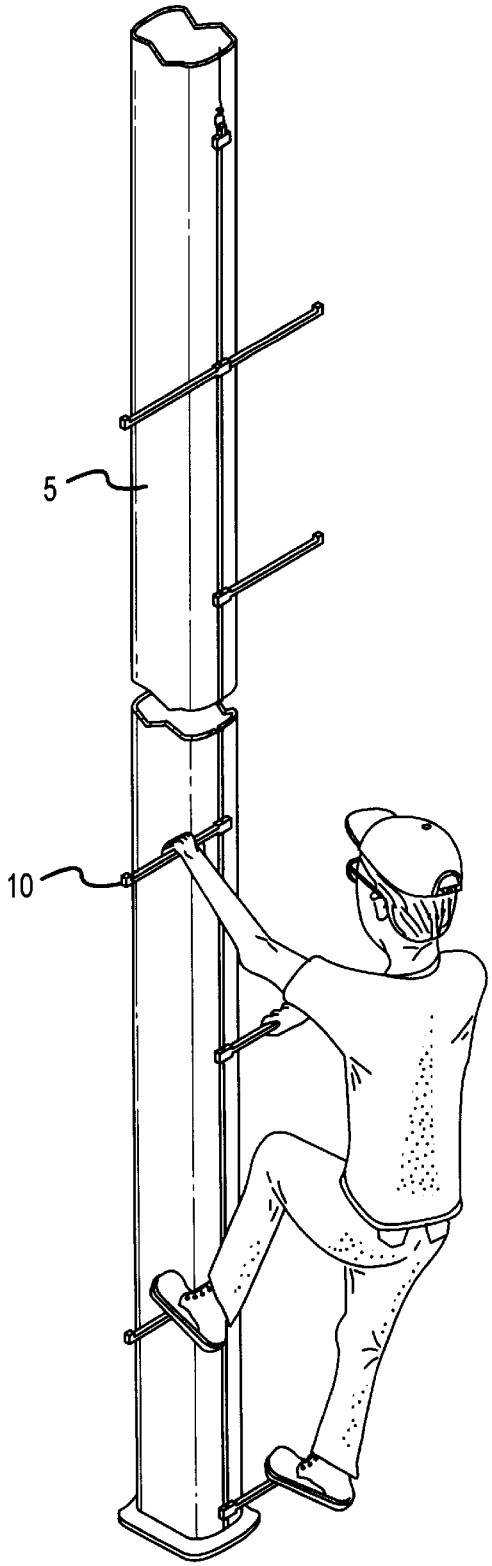
FIG. 1 is a perspective view showing the mast ladder made according to the invention in use.

Referring to the figures, as shown in FIG. 1, a mast ladder 10 made according to the invention is shown mounted to mast 5 of a sailing craft (not shown).

Figure 2:
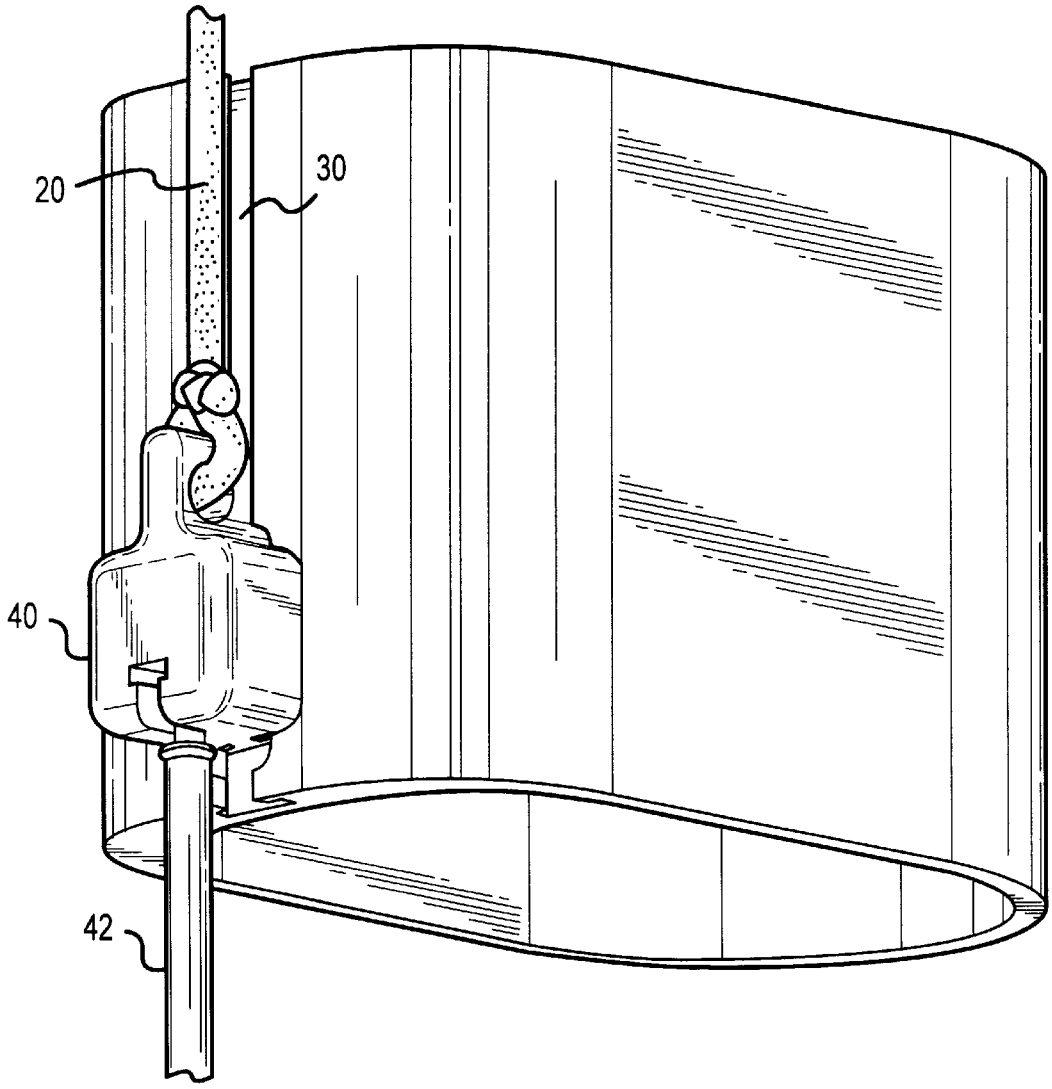
FIG. 2 is a perspective view showing the halyard slide in place with the connecting rod affixed.
Figure 3:
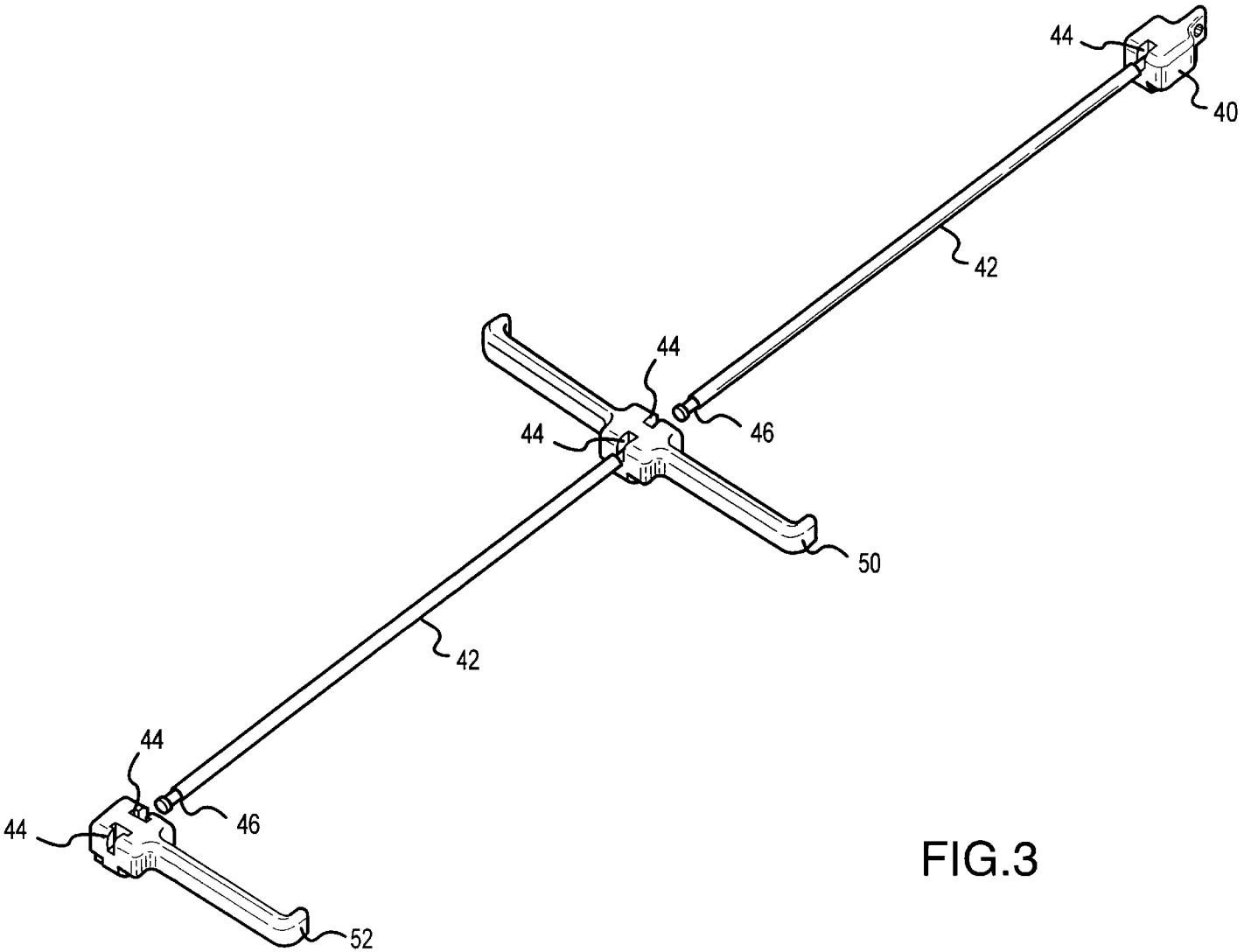
FIG. 3 is a perspective view showing the assembly of the mast ladder.

In operation, mast ladder 10 is made of aluminum and is assembled by attaching the halyard 20 to the upper portion of the halyard slide 40 and inserting the halyard slide 40 into mast slide 30 and affixing connecting rod 42 in connecting slot 44 as shown in FIG. 2. Mast ladder 10 is raised by raising halyard 20. Connecting rod 42 has a connecting rod notch 46 at each end allowing connecting rod 42 to be inserted into connecting rod slot 44. The connecting rod 42 is then affixed to the upper portion of the top step 50 which is inserted into the mast slide 30 and the assembled portion is raised by the halyard 20 allowing another connecting rod 42 to be affixed to the lower portion of the top step 50 by inserting the connecting rod notch 46 of connecting rod 42 into connecting rod slot 44. The top step 50 is wide enough for both feet of an individual to stand on in order to perform the necessary work for which the individual needed to go up the mast ladder 10. The connecting rod notch 46 of connecting rod 42 is inserted into one of the connecting rod slots 44 of the universal step 52 which is inserted into the mast slide 30 and raised by halyard 20. The universal step 52 provides approximately one half of the step width of the top step 50. Thereafter, each universal step 52 is rotated prior to inserting into the mast slide 30 so that the universal step 52 alternates from the left to the right or the right to the left depending on the direction that the first universal step 52 was set. An "O" ring, (not shown) is placed on the inner most part of the connecting rod notch 46 to provide a snug fit to each of the attachments of the connecting rods 42 between the connecting rod slot 44 and the connecting rod notch 46. The "O" ring gives the mast ladder 10 some rigidity as the mast ladder 10 is assembled so that the connecting rods 42 do not separate at the connecting rod notch 46 and connecting rod slot 44.

Modifications and variations can be made to the disclosed embodiment without departing from the subject of the invention as defined in the following claims. For example, although the mast ladder 10 is described as being made from aluminum could be made of many other materials such as plastic or other material capable of supporting an individual. Additionally, the universal step 52 could be replaced by a dual step such as the top step 50.

What I claim:

1. A mast ladder for use with a mast on a sailing craft having a sail slide along the length of the mast and a halyard extending from the upper portion of the mast, the mast ladder comprising:

a halyard slide means having an upper and a lower portion wherein said upper portion is adapted to be affixed to said halyard for raising said mast ladder;

means coupling the inner edge of said halyard slide means to said sail slide;

said halyard slide means having said lower portion having a connecting rod slot means for affixing a connecting rod;

a plurality of said connecting rods whereby said connecting rods have a connecting rod notch means which interconnects with said connecting rod slot means for erecting said mast ladder;

a top step means having an upper portion and a lower portion for providing support to an individual when said mast ladder is raised;

a first means for coupling said top step means to said sail slide;

said top step means affixed to said halyard slide means at said upper portion by said connecting rod means;

a plurality of universal step means for forming a ladder;

said lower portion of said top step means affixed to said universal step means by said connecting rod means;

a second means for coupling said universal step means to said sail slide;

whereby each universal step means thereafter is added having a connecting rod affixed and said universal step means is rotated such that said universal step means alternates every other time on the left and on the right of said mast ladder until the top of said mast slide is reached.

2. The mast ladder of claim 1 wherein said top step means is an aluminum step.

3. The mast ladder of claim 1 wherein said halyard slide means is an aluminum halyard slide.

4. The mast ladder of claim 1 wherein said universal step means is an aluminum universal step.

5. The mast ladder of claim 1 wherein said connecting rod means is an aluminum connecting rod.

6. A mast ladder for use with a mast on a sailing craft having a sail slide along the length of the mast and a halyard extending from the upper portion of the mast, the mast ladder comprising:

a halyard slide having an upper and a lower portion wherein said upper portion is adapted to be affixed to said halyard for raising said mast ladder;

means for coupling the inner edge of said halyard slide to said sail slide;

said halyard slide having said lower portion having a connecting rod slot for affixing a connecting rod;

a plurality of said connecting rods whereby said connecting rod have a connecting rod notch which interconnects with said connecting rod slot for erecting said mast ladder;

a top step having a upper portion and a lower portion for providing support to an individual when said mast ladder is raised;

first means for coupling said top step to said sail slide;

said top step affixed to said halyard slide at said upper portion by said connecting rod;

a plurality of universal steps for forming a ladder;

said lower portion of said top step affixed to said universal step by said connecting rod;

second means for coupling said universal step to said sail slide;

whereby each universal step thereafter is added having a connecting rod affixed and said universal step is rotated such that said universal step alternates ever other time on the left and on the right of said mast ladder until the top of said mast slide is reached.

* * * * *